United States Patent [19]

Crawford

[11] Patent Number: 4,512,264

[45] Date of Patent: Apr. 23, 1985

[54] INDUCED STACK DRAFT APPARATUS

[76] Inventor: James P. Crawford, P.O. Box 13243, Orlando, Fla. 32859

[21] Appl. No.: 546,992

[22] Filed: Oct. 31, 1983

[51] Int. Cl.[3] ..... F23L 17/16; F23N 3/00

[52] U.S. Cl. ..... 110/160; 98/78

[58] Field of Search ..... 110/160, 161, 162; 98/58, 78

[56] References Cited

U.S. PATENT DOCUMENTS 2,722,372 11/1955 Edwards ..... 110/160 X 2,979,322 4/1961 Dailey, Jr. ..... 110/160 X 3,134,345 5/1964 King ..... 110/160

*Primary Examiner*—Edward G. Favors

*Attorney, Agent, or Firm*—William M. Hobby, III

[57] ABSTRACT

An apparatus to induce drafts in combustion chamber stacks can operate at temperatures from 1400° to 2600° while being fabricated from mild steel with refractory lining. The induced draft apparatus includes an exhaust stack connected to a combustion chamber and has an annular plenum formed around the base of the stack with a narrowed annular outlet from the plenum into the stack. An air blower is connected to the annular plenum for directing air under pressure thereinto and into the stack at a predetermined position. An annular refractory surface is formed on the inside of the plenum wall in the stack and the stack is similarly lined with a refractory material.

4 Claims, 2 Drawing Figures

FIG. 1
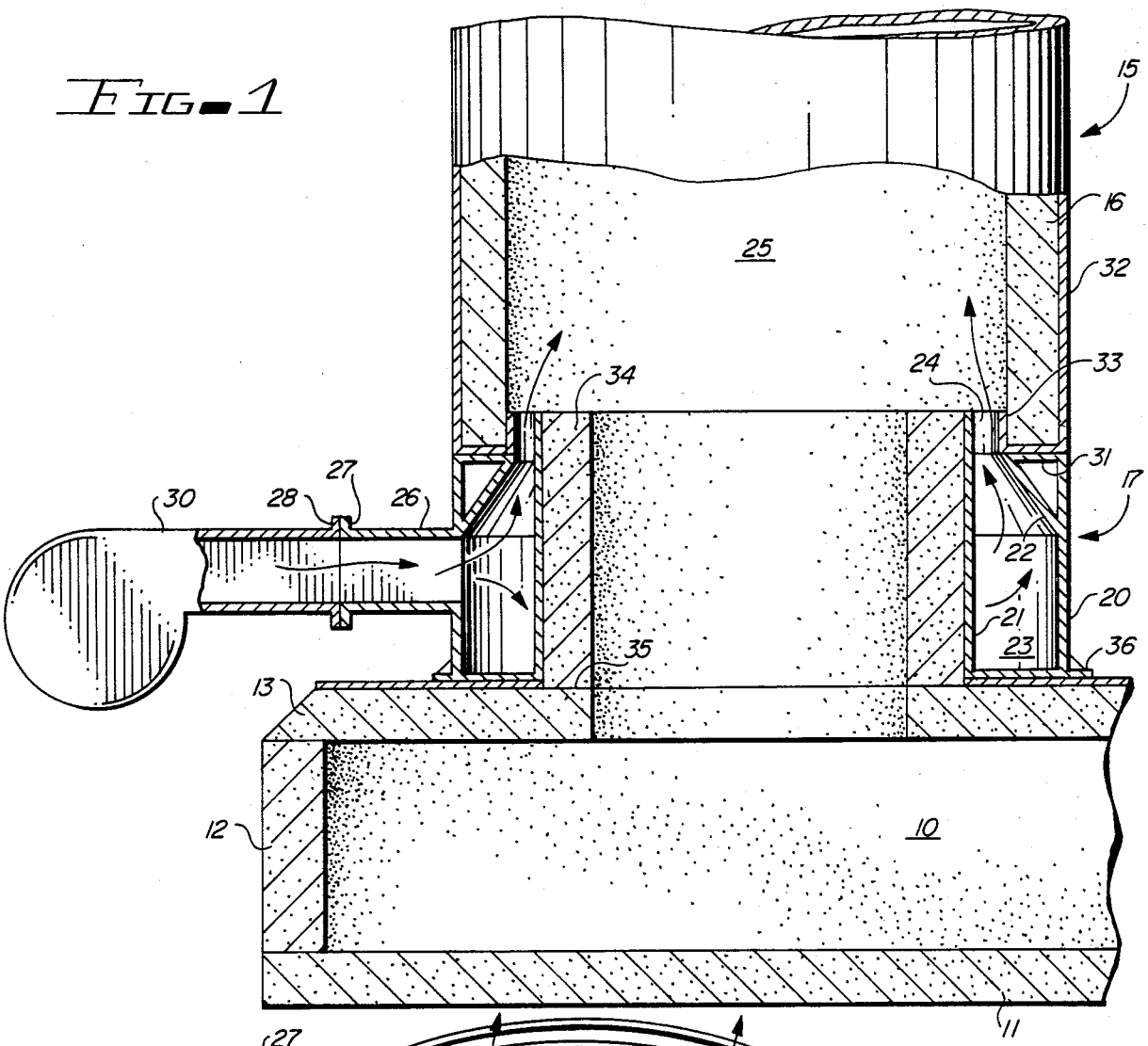
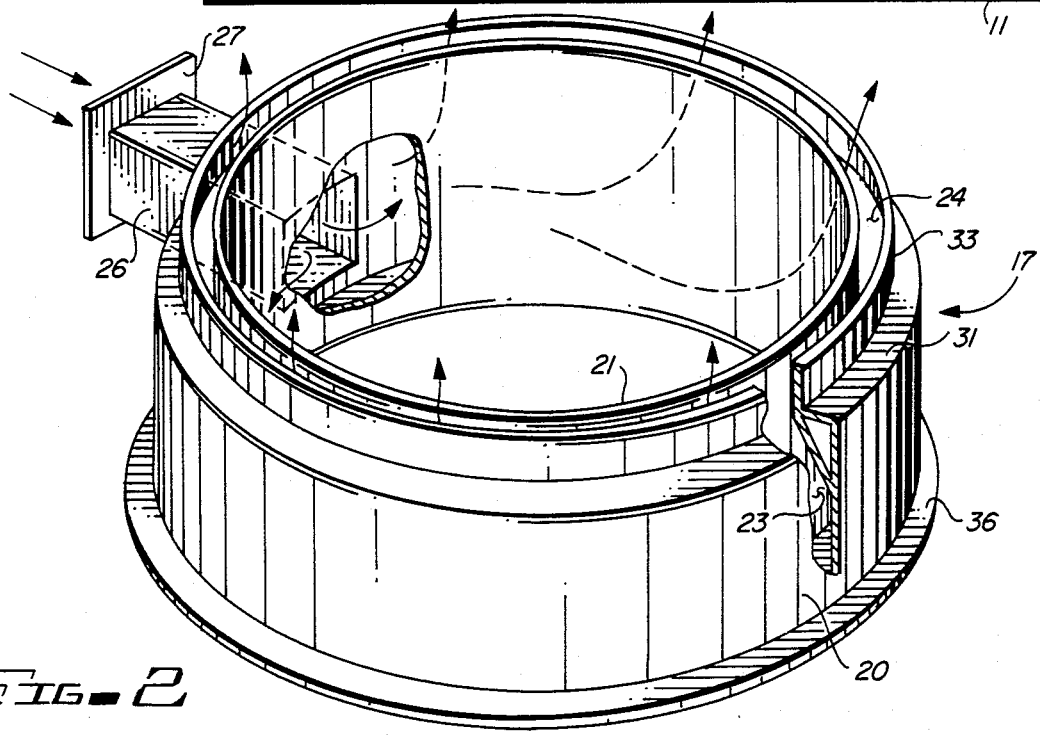
FIG. 2

INDUCED STACK DRAFT APPARATUS

BACKGROUND OF THE INVENTION

The present invention relates to stacks for fired combustion chambers and especially to an induced draft system which produces the necessary draft for a combustion chamber with a shortened stack.

In the past, it has been common to provide various types of combustion chambers for all types of uses and typically these have a stack design thereof on top of a predetermined height and shape to produce a draft up the stack generated by the heat and flow of air from the combustion chamber. Stacks have generally been required to have a predetermined height and shape in order to produce a sufficient draft to produce the necessary combustion heat in a combustion chamber. To overcome the problem with the height of the stack, it has been suggested in the past to blow air at predetermined positions in the stack to induce a draft in the stack. This has the advantage of not only reducing the height of the stack, but the increased oxygen of the stack produces a more complete combustion for many combustion chambers. Stack using draft control by the insertion of air under pressure may be seen in the King U.S. Pat. No. 3,134,345, which produces a flow of air in a circular ring directed towards the center of the stack. In the Kneass, Jr. U.S. Pat. No. 2,951,457, the air is also blown into an injector stack through an annular opening. Other U.S. patents of interest may be seen in the Campbell U.S. Pat. No. 2,584,326 for a stack draft booster and control device for combustion apparatus; while the Young U.S. Pat. No. 2,929,342 and in the Sherman U.S. Pat. No. 2,869,487 are for incinerators.

In contrast to the above patents, the present invention is directed towards an induced draft device which blows air into an enlarged annular plenum and then forces the air through a narrowed annular venturi into the stack, and which may be made of a mild steel while operating at very high temperatures by the use of a refractory lining built into the interior surface and covering the bottom portion of the annular plenum of the induced draft device.

SUMMARY OF THE INVENTION

The present invention deals with an induced draft apparatus for attachment to a combustion chamber in the base of an exhaust stack operatively connected to the combustion chamber for exhausting combustion gases therethrough. An enlarged annular plenum is formed around the base of the stack and has a narrowed annular outlet therefrom into the stack. An air blower is connected to the annular plenum for directing air under pressure into the annular plenum and through the narrowed opening into the stack in a predetermined postion. An annular refractory surface is formed on the inside of the plenum wall in the stack, so that a mild steel can be utilized in a high temperature combustion chamber. The induced draft device is designed to support the refractory material of the remainder of the shortened stack.

BRIEF DESCRIPTION OF THE DRAWINGS

Other objects, features and advantages of the present invention will be apparent from the written description and the drawings, in which:

FIG. 1 is a side sectional view of an induced draft device in accordance with the present invention attached to a combustion chamber and stack; and FIG. 2 is a cutaway top perspective view of an induced draft device for attachment to a combustion chamber and stack in accordance with FIG. 1.

DESCRIPTION OF THE PREFERRED EMBODIMENTS

Referring to the drawings, a combustion chamber 10 is illustrated having a base 11, sides 12 and a roof portion 13, along with a stack 15 extending therefrom. The stack 15 is lined with a refractory material 16, while the combustion chamber 10 is shown being made of a refractory material. The combustion chamber 10 has an induced draft device 17 mounted on the top thereof to a mild steel surface 18. The induced draft device 17 has an outer wall 20, an inner wall 21, along with an angled wall 22 forming an annular enlarged plenum 23. A narrowed annular outlet 24 forms an annular venturi from the enlarged plenum 23 to the interior of the stack 25. The induced draft device 17 has an outlet 26 from the plenum 23 having a flange 27 for connection to a flange 28 of an air blower 30. An air blower 30 directs air under pressure into the plenum 23 and out the annular opening 24 into the interior of the stack 25. Because of the enlarged annular plenum 23 fed through the narrowed annular opening 24, an increased velocity of the air under pressure exits from the induced draft 17 up along the edges of the refractory material 16 and the stack 15, thus cooling the lower refractory material at the same time as increasing the draft from the combustion chamber 10 out the stack 15. An angled wall 12 is connected to a top ledge surface 31 and to the wall 20 to form a reinforcing triangle on the top of the induced draft device 17 for supporting the outer wall 32 of the stack 15 and the refractory lining 16 thereon adjacent the annular lip 33.

In the present invention, the combustion chamber 10 has the refractory material 13 extending to form a match with the refractory lining 34 which lines the stack side of the plenum wall 21. Thus, the refractory lining 34 and the refractory material 13 form an annular abutting joint 35 providing a continuous lining from the combustion chamber 10, past the induced draft system 17 and into the lined stack 15. The induced draft device 17 can be made of a mild steel because of the refractory lining 34 joining the refractory material 13 at the abutting joint 35. In addition to the cooling affect of the air from the blower 30 continuously passing through the plenum which helps maintain the steel in the induced draft device at a sufficient temperature for operation of the combustion chamber at a high temperature. The induced draft device, in turn, reduces the size of the stack while the inputted air through the induced draft device is preheated and provides additional oxygen for more complete combustion of the exhaust gases. The base of the induced draft device 17 can be seen as having an annular support flange 36.

The present induce draft system provides a prefabricated unit which can be readily attached to the base of the stack at the outlet from a combustion chamber and which can be made out of less expensive hot or cold rolled mild sheel steel, pre-lined with a refractory material such as 2800° Kaocrete refractory material designed to handle exhaust and gases from 1600° to 2600°. The unit is designed for self support as well as supporting the weight of the stack placed thereon with refractory material to form an annular abutting joint between the stack and the induced draft device.

It should be clear at this point that a draft device has been provided which allows the use of less expensive materials and which can be rapidly produced in a prefabricated unit for attachment to a combustion chamber and stack. It should, however, be clear that the present invention is not to be construed as limited to the forms shown, which are to be considered illustrative rather than restrictive.

I claim:

1. An induced draft apparatus comprising in combination:

a combustion chamber;

an exhaust stack operatively connected to said combustion chamber;

induced draft means attached between said combustion chamber and said exhaust stack around the base of said exhaust stack and having an annular plenum formed of mild steel, an air blower connected to said annular plenum for directing air under pressure into said annular plenum and out a narrowed annular opening into said stack, whereby the velocity of the air leaving said annular plenum is increased as it exits into said stack;

an annular refractory surface formed on the inside of the inside wall of said plenum wall and abutting refractory material in the combustion chamber, whereby said plenum wall is protected from heat and exhaust gases passing through said stack; and said induced draft means having a reinforced annular ledge having an annular lip therearound for attachment of the base of a stack lined with a refractory material thereon.

2. An induced draft apparatus in accordance with claim 1, in which said annular opening from said annular plenum forms an annular venturi between the plenum and the exhaust stack.

3. An induced draft apparatus in accordance with claim 1, in which said induced draft apparatus has a flanged base for support on the top surface of said combustion chamber.

4. An induced draft apparatus in accordance with claim 3 in which said induced draft means has an air inlet thereinto having a flanged end for attaching to a flange of an air blower.

* * * * *